United States Patent [19]

Voorheis et al.

[11] 4,303,386

[45] Dec. 1, 1981

[54] PARALLEL FLOW BURNER

[75] Inventors: Temple S. Voorheis, Atherton; Ralph R. Vosper, San Jose; Chester S. Binasik, Palo Alto; Norman Harthun, San Carlos, all of Calif.

[73] Assignee: Coen Company, Inc., Burlingame, Calif.

[21] Appl. No.: 40,390

[22] Filed: May 18, 1979

[51] Int. Cl.[3] ..... F23C 5/08

[52] U.S. Cl. ..... 431/177; 431/183; 431/284

[58] Field of Search ..... 431/175, 177, 181, 182, 431/183, 187, 188, 284, 285, 351; 239/424, 424.5, 425

[56] References Cited

U.S. PATENT DOCUMENTS

| | | | |
|---|---|---|---|
| 2,822,864 | 2/1958 | Black | 431/175 |
| 2,851,093 | 9/1958 | Zink et al. | 431/285 |
| 2,933,259 | 4/1960 | Raskin | 239/431 |
| 3,074,361 | 1/1963 | Hugh et al. | 431/284 |
| 3,244,220 | 4/1966 | Kloecker | 431/177 |
| 3,284,069 | 11/1966 | Levaux | 431/175 |
| 3,476,321 | 11/1969 | Levaux | 431/285 |
| 4,141,505 | 2/1979 | Reich | 239/431 |

*Primary Examiner*—Carroll B. Dority, Jr.

*Attorney, Agent, or Firm*—Townsend and Townsend

[57] ABSTRACT

A burner which has a central liquid fuel atomizing nozzle is disclosed. An inner member defines a steam chamber and is surrounded by a shell that defines a liquid fuel compartment. A conduit extends from the steam chamber forming a steam core flow. A first passage feeds liquid fuel about the steam core flow to form an annular liquid fuel stream thereabout. A second passage forms an outer steam flow which envelops the annular liquid fuel flow. The burner further includes ducts to form a first combustion airflow co-axially about the nozzle, a second combustion airflow which surrounds the first flow, and a third combustion airflow which envelops the second flow and generally protects the furnace wall from coming into contact with the flame generated by the burner. Gas spuds are placed in the second combustion airflow and each spud includes a discharge plate which generally faces in the direction of combustion airflow and which has one or more gas discharge holes arranged to cause the gas streams to substantially cover the entire space occupied by the gas stream downstream of the nozzle and upstream of the combustion chamber of the furnace. The plates of the spuds are relatively thick and the gas is supplied to the spuds at a relatively low pressure.

28 Claims, 7 Drawing Figures

PARALLEL FLOW BURNER

BACKGROUND OF THE INVENTION

The present invention relates to a burner for use in connection with industrial furnaces which are capable of firing either gaseous or liquid fuels and of efficiently operating over a wide operating range with relatively low excess air and at low emission levels.

The increasingly serious fuel shortage requires that furnace, particularly for industrial applications, operate as efficiently as possible over the entire operating range of such burners. Frequently, the range may extend from a maximum capacity to as low as 5% thereof. In the past, improvements in the operating efficiencies of such burners were attempted by such diverse means as minimizing of the combustion air supply or by controlling the flame temperature, the flame shape and size, the combustion air speed past the fuel nozzles, etc. Hand in hand with the need for an improved operating efficiency goes the requirement for minimizing the generation and discharge of pollutants such as soot or nitrogen oxides (hereinafter "NOX").

In the past, the perhaps most noteworthy development in this regard has been the production of burners which have a centrally located fuel nozzle, a flame stabilizer or "swirl plate" positioned concentrically immediately upstream of the nozzle so as to induce turbulence to the combustion airflow in the vicinity of the nozzle, while an additional combustion airflow disposed radially outward of and surrounding the turbulent core flow remains substantially laminar. In this manner, excessive flame turbulence was reduced as contrasted with other prior art burners which employed flame stabilizers extending over the entire or at least over a substantial portion of the cross-section of the combustion airflow past the nozzle. Additionally, the combustion air conduit of the burner sometimes received an advantageous venturi configuration in the vicinity of the fuel nozzle which has a tendency to reduce the power requirements of the combustion air fan.

An article by H. P. Niepenberg entitled "Entwicklungstendenzen Im Grossbrennerbau" (Trends in the Development of Large Burners) appearing in the German magazine *Technische Mitteilungen,* 65th Year, Volumne 3 of March, 1972 traces the development of such burners and discusses their construction in some detail.

Although these prior art burners were no doubt a significant improvement over other and earlier burners, their operating efficiency still was not as high as one might hope for. At least in part, this appears to be a result of the relatively turbulent flame generated by such burners which requires a significant amount of excess air which, of course, lowered their operating efficiency. Further, the flame turbulence inceased the combustion speed and thereby increased the maximum temperatures developed in the flame which, in turn, has a tendency to increase the generation of polluting NOX. Although certain refinements and changes could be made to the burner, such as the provision of the above-mentioned venturi throat to enhance certain aspects of its operation, the overall efficiency and pollutant discharge volume could only be insignificantly changed.

Thus, there is presently a need for a burner of the type generally discussed above which departs from prior art burner configurations so as to both significantly enhance its operating efficiency while limiting or, preferably, substantially reducing the pollutants, especially NOX.

SUMMARY OF THE INVENTION

The present invention is directed to a furnace burner for alternative or simultaneous gas and liquid fuel firing which has a significantly improved operating efficiency as compared to prior art burners of the type discussed above and which, in addition, reduces the emission of pollutants, particularly NOX. Broadly speaking, the invention accomplishes this by adding to a burner such as the one discussed above an outer combustion air sheath or flow at a point downstream of the fuel nozzle which entirely envelops the laminar combustion airflow that surrounds the "swirling" or relatively turbulent core airflow. In this manner, a more uniform and less turbulent flame can be formed. As a result the burner can be operated with relatively reduced excess air since pockets of fuel concentration in parts of the flame due to a turbulent flame pattern are substantially reduced or eliminated. Further, the burner can be operated at a relatively lesser air speed, thereby prolonging the flame and the combustion process which, in turn, lowers the maximum flame temperatures and the generation of NOX. Thus, a burner constructed in accordance with the present invention is both more efficient and less polluting than prior art burners.

The efficiency of the burner is further enhanced by constructing the liquid fuel nozzle so that it atomizes the liquid fuel (hereinafter "oil") into a homogenous, even spray with a steam requirement of as little as one-third of the steam required by prior art oil atomizers. This is accomplished primarily by constructing the nozzle so that the major portion of the atomizing steam travels through the nozzle substantially unidirectionally, that is without having to pass through a multitude of sharp, e.g. 90° turns which dissipate great amounts of steam energy. A nozzle constructed in accordance with the present invention thus can result in steam generation cost savings of as much as $10–20,000 per year.

Further, the nozzle is constructed so that oil issuing from the discharge jets of the nozzle are enveloped by a steam layer as they pass through the jets in the nozzle cap. Any direct contact between the liquid fuel and the cap walls is thereby prevented. This prevents the heretofore common coking of oil along the hot nozzle cap and the resulting deposit of such coke, soot and the like on the burner, the furnace walls and the exhaust stack. Typically, a nozzle constructed in accordance with the present invention experiences no coking and can be continuously operated while prior art nozzles had to be removed from the burner and cleaned every two to eight hours.

The burner of the present invention is further provided with gas spuds, for the above-mentioned alternative and/or simultaneous operation with a gaseous fuel (hereinafter "gas"). Each spud is constructed of a generally radially oriented tubular member that extends into the airflow surrounding the "swirling" core airflow and has a slanted end cap that faces in the direction of the airflow. The end cap includes a plurality of gas discharge openings of a relatively large diameter and the plate is relatively thick so as to impart good directionality to the gas stream issuing from the holes in the cap. The holes are further oriented so that all gas streams issuing from all spuds substantially fully penetrate the space occupied by the laminar airflow surrounding the core flow and by the radially outer portion of the latter at points downstream of the spuds. In this manner, an interference of the gas streams with each other is prevented while the gas is evenly distributed throughout the airflow to assure an efficient combustion. All this is accomplished while the gas spuds are operated at a relatively low pressure, typically of no more than about 10 psi.

In the past, such low pressure operation was not possible whenever directional stability of the issuing gas streams was desired since the holes by necessity had to be of very small diameters in order to impart to the gas streams a sufficient momentum so that they retain the desired directionality over the required length of travel. Thus, the gas pressure had to be much higher. The resulting higher gas flow speeds, however, led to an increased turbulence which adversely affects both the operating efficiency of the burner and the generation of NOX.

Structurally, a burner construced in accordance with the present invention generally comprises a centrally located nozzle for the discharge of oil in a downstream direction towards a combustion chamber of the furnace. The nozzle itself has an inner member which includes an axially extending bore that defines a central chamber. The inner member further includes both an aperture and a conduit spaced therefrom which generally extend in an axial direction, that is which do not deviate by more than about 30°–45° therefrom, and which are in fluid communication with the central chamber. Means is provided for connecting the bore to a supply of steam. A shell is co-axially disposed about the inner member and is dimensioned to define an oil compartment between the member and the shell. The shell includes means defining first and second holes of successively larger cross-sections in axial alignment with and successively further spaced from the conduit in the inner member. The second hole defines a jet from which the oil is discharged and atomized. The shell further defines a first passage which communicates the oil compartment with a space between the conduit and the first hole. This first passage is arranged and dimensioned so as to fully extend radially about and beyond the first hole. The shell further defines a second passage which communicates the aperture with a space between the first and second holes. The second passage also fully extends radially about and beyond the second hole. A steam-oil flow exits from the second hole upon the application of steam to the central chamber and of oil to the compartment. The steam-oil flow comprises a steam core flow, an annular oil flow surrounding the core flow and an annular steam flow enveloping the oil flow so that the latter is atomized by the steam when it issues from the nozzle jet, i.e. from the second hole while any contact between the liquid fuel and walls of the second hole is prevented.

The burner further comprises means for forming a first combustion airflow substantially co-axially about the nozzle, means for swirling the first airflow about its axis and means for flowing a second, substantially laminar, i.e. straight combustion airstream co-axially about the first airstream past the nozzle and towards the furnace chamber. A third, laminar airstream is formed to substantially fully envelop the second airstream with the third airstream at a point downstream of the nozzle to limit the diameter of the flame produced by the nozzle and to thereby prevent substantial contact between the flame and a burner throat defined by the furnace wall.

The burner also has a plurality of spaced apart gas spuds arranged in the second airflow, each spud including a cap generally facing in the direction of the airflow, each cap including a plurality of relatively large diameter gas discharge openings so that a gas stream issues from each such opening and enters the second gas stream. The plate has a thickness at least about 0.75 times the diameter of the openings and the latter are arranged so that the gas stream discharged by each follows a trajectory with prevents an interference of such stream with the streams discharged by the other openings, so that all gas streams substantially fully penetrate the space occupied by the second airflow and the radially outer portion of the first airflow, and so that substantially no portion of the gas streams flows radially beyond the second airstream.

The burner includes a combustion air supply duct which allows an adjustment of the relative airflows, particularly of the first and second airflows. Typically, these airflows are adjustable so that 20–40% of the entire combustion air flows in the first or core stream, 30–50% of the entire combustion air flows through the laminar, second airflow surrounding the core stream, and 20–40% of the entire combustion air flows in the third, enveloping airstream. The latter is preferably introduced immediately upstream of the burner throat by providing a perforated cyclinder between the outside of the furnace wall and the combustion air duct.

Further, to enable the off-stoichiometric operation of the burner, means is provided in the form of a plurality of spaced apart tubes evenly distributed about the burner throat for introducing the required additional combustion air into the furnace to assure a complete combustion of all fuel. In one embodiment of the invention, the end of the tubes facing the firing chamber are flattened in a direction generally parallel to the proximate circumference of the burner throat so as to achieve a more even, circular distribution of the additional air. This embodiment of the invention has the advantage that as a result of the off-stoichiometric operation of the burner, the combustion is prolonged, the combustion temperatures are reduced and, thereby, the production of NOX is also reduced.

The enveloping, third airflow not only keeps the flame and the combustion airflow more uniform, it helps restrict the flame in a radial direction and prevents it from contacting and overheating the surrounding burner throat. While an initial restriction of the flame (in a radial direction) is desirable, once the flame enters the firing chamber it is preferable that the flame be permitted to fan out in a radial direction rather than extend narrowly and deeply into the chamber. To accomplish this the burner throat is stepped, that is it has a relatively small diameter, cylindrical outer opening proximate the outer surface of the furnace and a relatively large diameter, cylindrical inner opening adjacent the inner surface wall rather than the heretofore common conical shape. This stepped configuration of the burner throat forms a secondary flame recirculation zone immediately downstream of the outer opening and fans the flame outward as it enters the combustion chamber, that is it renders the flame relatively wider which is desirable in most furnaces. In addition, the secondary recirculation zone facilitates a slow burn rate for the flame and helps prevent the flame from lifting off the burner nozzle.

Thus, the present invention greatly enhances the efficiency of the burner by permitting its operation with reduced excess air and by minimizing its liquid fuel atomizing steam consumption, and by reducing the emission of pollutants in general and of NOX in particular. It further shapes the flame into a highly desirable, uniform and relatively non-turbulent pattern and protects furnace components in the vicinity of the flame against direct contact thereby and an excessive heating. All this is accomplished without increasing the overall costs of the burner to any significant degree.

DESCRIPTION OF THE PREFERRED EMBODIMENTS

Figure 1:
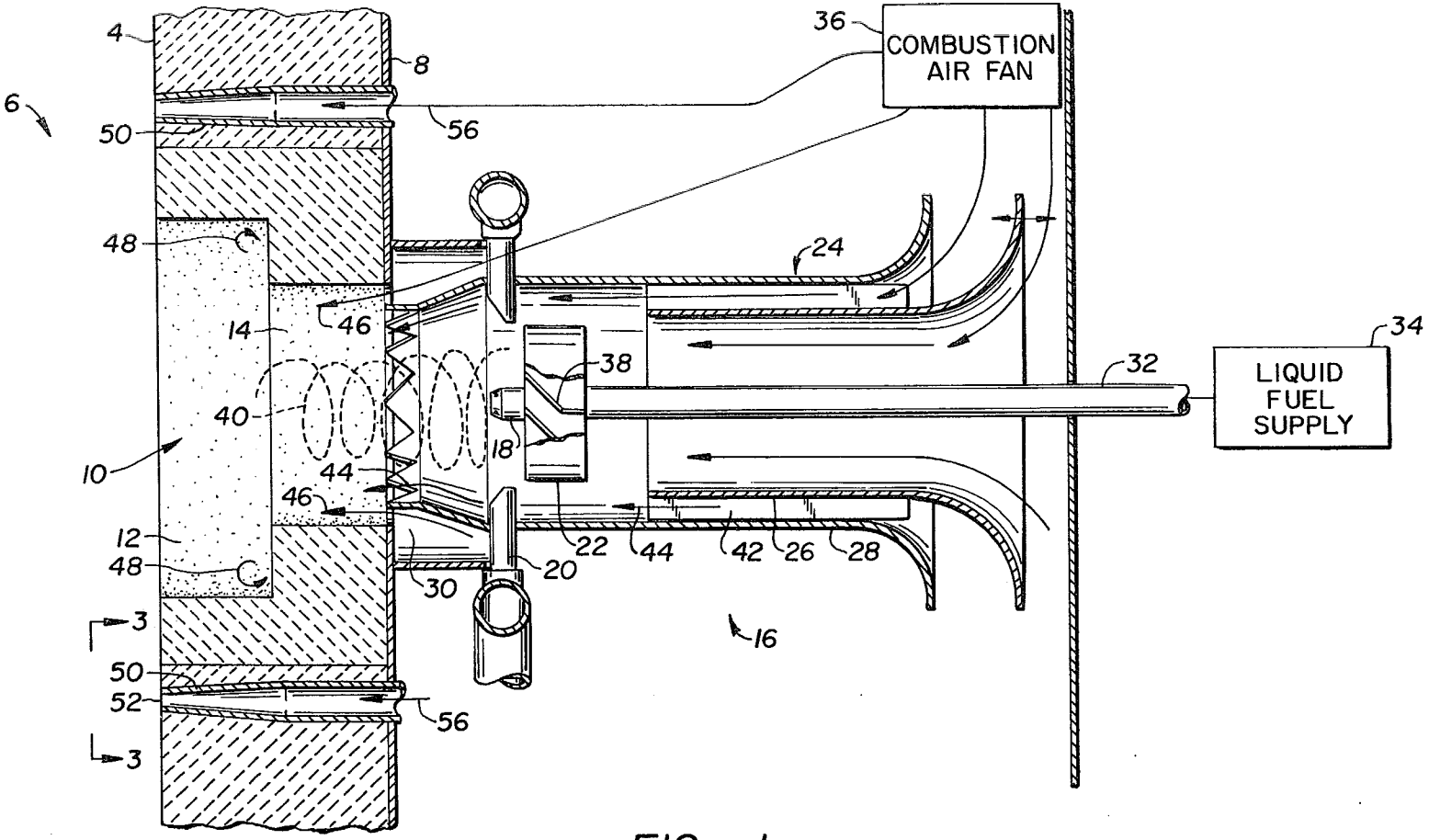
FIG. 1 is a fragmentary, side elevational view, in section, of a furnace wall and of a burner constructed in accordance with the present invention.

Referring first to FIG. 1, a furnace wall 2 includes an inner side 4 facing a firing or combustion chamber 6 and an outer side 8 facing the exterior. The wall includes at least one burner throat 10 defined by a cylindrical, relatively large diameter inner opening 12 and a contiguous, cylindrical, relatively small diameter outer opening 14. A burner 16 constructed in accordance with the present invention is placed against the outer side 8 of the furnace wall concentrically with respect to the burner throat.

Broadly speaking, the burner includes a co-axially mounted, liquid fuel (oil) nozzle 18, a plurality of radially inwardly extending gas spuds 20 mounted in approximately the same plane as the nozzle and arranged thereabout, a stabilizer 22 mounted concentrically with the nozzle immediately upstream thereof, an outer duct 24 and an inner duct 26 for supplying the burner with the required combustion air. The inner duct extends rearwardly (to the right as seen in FIG. 1) past the outer duct and both terminate in bell-shaped ends. The inner duct is further axially movable in the direction of the double arrow shown in FIG. 1 so as to regulate to a limited degree the relative air volume that can be introduced into the annular space between the two ducts. Further, there is provided a cylindrically shaped, perforated air intake shield 30 downstream of the oil nozzle 18 which generally has the same diameter as the outer duct 24 and which approximately spans the distance between the outside 8 of the furnace wall and the oil nozzle. Finally, a pipe 32 connects the oil nozzle with a supply 34 of liquid fuel.

In operation, combustion air from a fan 36 is directed into the inner duct 26 and flows initially in an axial direction to the flame stabilizer 22. The stabilizer includes slanted vanes 38 which spin, or impart a "swirl" to the inner flow to form a relatively turbulent but small diameter core flow 40 of combustion air downstream of the spinner as is indicated by the spiral line in FIG. 1. The air from fan 36 further enters the annulr space 42 between the the inner and outer ducts 26, 28 to form an essentially laminar, that is an essentially linear and non-turbulent second airflow 44 which surrounds the core flow and which has a relatively laminar boundary downstream of the liquid fuel nozzle 18. Air from the fan further enters the burner throat 10 through the perforated intake shield 30 and forms a third combustion air flow 46 downstream of the nozzle and within the burner throat which, in effect, is an enveloping sheath for the first and second combustion airflows. The relative air volume of the first and second flows can be adjusted by moving the inner duct 26 in an axial direction as is schematically illustrated by the arrow in FIG. 1.

Nozzle 18 atomizes oil into the core flow 40 where it is ignited to form a flame. Because of its swirling motion, the core flow propagates relatively slowly (as compared to the second air flow 44) towards the firing chamber 6. This assures that the flame remains anchored to the nozzle at all times, by preventing the flame from wandering off the nozzle which could result in a flame-out. As the oil burns, it expands outwardly into the second combustion airflow 44 where its motion becomes more laminar, that is where the swirling component of the flow is redirected into a straight line flow towards the firing chamber. The enveloping third airflow 46, however, prevents a significant further expansion of the flame, especially in the vicinity of the outer burner throat opening 14, and thereby prevents direct contact between the flame and the burner throat and a possible local overheating of the furnace wall 2.

As the flame propagates downstream towards the firing chamber, it enters the relatively large diameter, inner throat opening 12. The sudden expansion of the throat diameter forms a secondary recirculation zone 48 which has a tendency to expand the flame in a radially outward direction and facilitates the intermixing of the flame and of unburned fuel therein with the third airflow to effect the combustion of all fuel as the flame enters and propagates into the firing chamber of the furnace. This expansion takes place gradually so that the flame expands and becomes more bushy as it enters the firing chamber.

As was mentioned above, a significant portion of the combustion air passing the nozzle, that is the entire outer or second airflow 44 is an essentially laminar flow. As a result, the flame is not subjected to excessive turbulence but rather propagates relatively evenly and homogenously towards the firing chamber. As a result, the formation of concentrated pockets in parts of the flame, as is common in turbulent flames, is substantially reduced or eliminated. Consequently, the burner can be operated with significantly less excess air than was heretofore the case.

Figure 3:
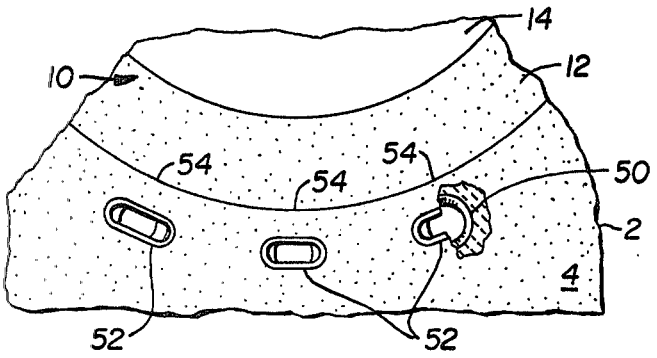
FIG. 3 is a fragmentary, elevational view of the inside of the furnace wall and is taken on line 3—3 of FIG. 1.
Figure 4:
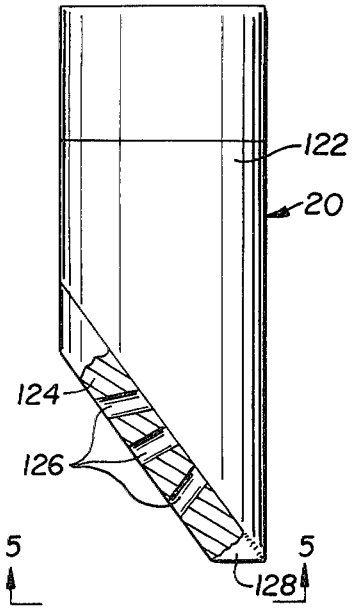
FIG. 4 is a side elevational view, partially in section, of a gas spud constructed in accordance with the present invention.
Figure 5:
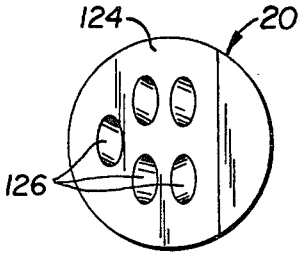
FIG. 5 is an end view of the gas spud shown in FIG. 4 and is taken on line 5—5 of FIG. 4.

Referring now to FIGS. 1 and 3, the burner 16 of the present invention can also be operated offstoichiometrically by reducing the first through third combustion airflows 40, 44 and 46 and by providing a plurality of air tubes 50 which extend through the furnace wall 2 and through which a fourth airflow 56 streams to supply the necessary air for a complete combustion of all fuel. The air tubes are spaced apart and evenly arranged about the burner throat as is best seen in FIG. 3. An inner end 52 of each tube may be flattened in a direction generally parallel to the proximate periphery 54 of the throat (as shown in FIG. 3) to achieve a more uniform distribution of the fourth airflow 56. With the off-stoichiometric firing of the burner, the flame speed from the burner to the combustion chamber and the combustion as such is slowed down. Maximum flame temperatures are thereby reduced and, as a result, less NOX is generated by the burner.

Figure 2:
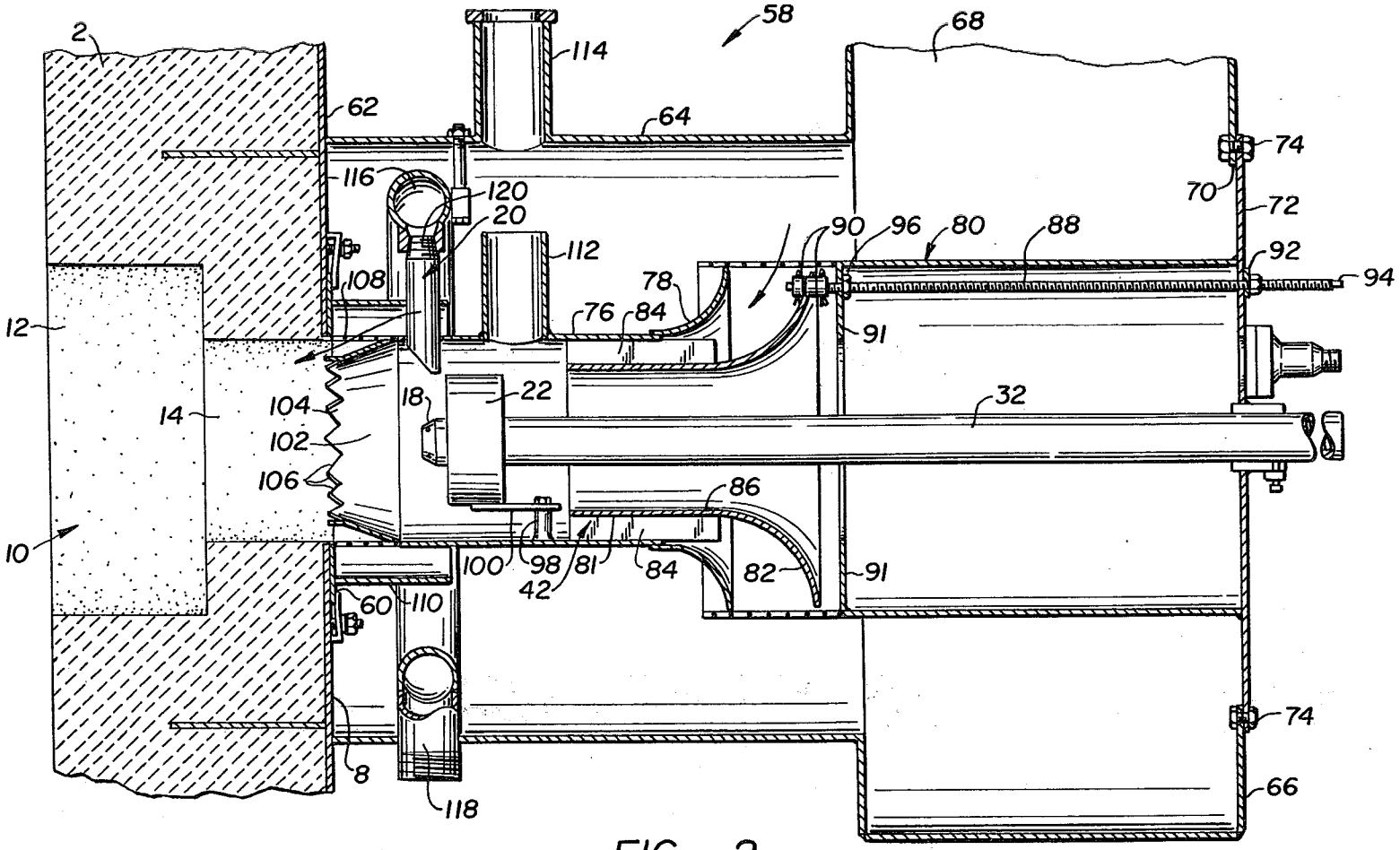
FIG. 2 is a side elevational view similar to that of FIG. 1 but illustrates the construction of the burner and the associated combustion air ducts in greater detail.

Referring specifically to FIG. 2, the construction of burner 16 can now be set forth in greater detail. Its front end is fitted with a face plate 60 that is suitably clamped and/or bolted to a mounting plate 62 placed against the outside 8 of and conventionally anchored to furnace wall 2. The mounting plate includes an opening which is concentric with burner throat 10. An outer duct or shell 64 is suitably secured, e.g. welded to the mounting plate 62 and protrudes perpendicularly away from the furnace wall. The outer shell has a generally cylindrical configuration and terminates in a wind box 66 which has an enlarged diameter relative to the remainder of the shell and which communicates with an air duct 68 that leads to the combustion air fan (not shown in FIG. 2). An aft end of the shell includes a relatively large diameter cutout 70 which is closed with a cover 72. Bolts 74 releasably secure the cover to the shell.

The burner includes a forward, main air tube 76 which is secured, e.g. welded to face plate 60 and which protrudes perpendicularly away from furnace wall 2. The inner diameter of the air tube about equals the diameter of the outer burner throat opening 14. The aft end of the air tube 76 is defined by a bell-shaped transition 78 the outer edge of which is secured to a second, relatively larger diameter support pipe 80 which extends rearwardly and is welded to cover 72. The support pipe is perforated, longitudinally slitted or the like so as to permit the relatively unimpeded passage of combustion air from its outside to its inside.

A cover tube 81 is concentrically disposed within the air tube 76 and support pipe 80. It has a lesser diameter than the air tube 76 so as to define the earlier discussed annular space 42 between them. Its aft end 82 is again bell-shaped and terminates in an outer, maximum diameter which is slightly less than the inner diameter of support pipe 80. A plurality of circumferentially spaced apart, axially oriented support plates 84 are secured to the outside of core tube 81 and they define inner edges 86 which support and slidably engage the inner surface of air tube 76 so that the latter can be moved therealong in an axial direction.

A relatively long, threaded rod 88 extends through a hole (not shown) in the bell-shaped aft end of the core tube 81 and is suitably fixed thereto with retaining washers 90 as is illustrated in FIG. 2. A ring or donut-shaped plate 91 depends radially inward from support pipe 80 and includes a hole through which the threaded rod extends rearwardly. The rod further extends rearwardly past duct cover 72 and threadably engages an appropriately threaded hole (which may be reinforced with a boss 92). An aft end of the rod may include a head 94 of a square or hexagonal cross-sectional, for example, so that the head can be engaged with a wrench or the like (not shown) and turned in one or the other direction. When the rod is turned it moves in an axial direction towards or away from the burner throat. This motion of the rod in an axial direction of the burner is transmitted to the core tube 81. In this manner, the effective cross-section between the bell-shaped transition 78 of air tube 76 and the bell-shaped end 82 of the core tube can be varied to correspondingly adjust the relative air volumes flowing through the core tube and the annular space 42 between the core tube and the air tube 76.

The ring-shaped plate 91 acts as a stop for the core tube beyond which it cannot move in a rearward direction. It also acts to suppress undesirable eddies in the bell-shaped aft end of core tube 81.

The threaded rod may be provided with a stop nut 96 which is fixed, e.g. welded to the rod at a predetermined position so as to limit the extent to which the core tube may be moved in a forward direction.

Still referring to FIG. 2, in the preferred embodiment of the present invention, air tube 76 includes a pedestal 98 which protrudes radially inwardly and which mounts the earlier mentioned stabilizer 22 concentrically within the air tube by means of a mounting plate or bracket 100. Further, the forward end of the air tube is provided with a generally frustoconically shaped crown section 102 which is secured, e.g. welded to the inside of the air tube at a point spaced rearwardly of mounting plate 60. The forward end of the crown section is in approximate alignment with the outer end of the burner throat 10 and it has multiple sawteeth 104 which are defined by slanted edges 106 of the crown section.

The sawtooth shaped end of the crown section facilitates the gradual intermixing of the earlier discussed second and third airflows. The sawtooth shaped end further helps to anchor the flame to nozzle 18. The exact reason why the sawtooth shaped end acts in this manner is not fully understood by applicants. However, applicants have determined that these benefits are attained when providing at least about ten and preferably between ten to sixteen sawteeth which are equally distributed about the diameter of the crown section irrespective of what that diameter is. Thus, depending on the diameter the sawteeth will vary in size.

Further, the portion 108 of the air tube between mounting plate 60 and the point of attachment of crown section 102 is perforated, that is it is provided with suitably shaped, sized and distributed apertures, slots and the like to permit the formation of the earlier discussed third airflow 46 which envelopes the core flow 40 and the surrounding, second airflow 44 (all of which are illustrated in FIG. 1 only). An enlarged diameter pipe 110 is preferably secured to the mounting plate concentrically with air tube 76 to protect the perforated portion 108 and to channel the air which then forms into the third airflow from shell 64 to the perforated pipe portion. It will be noted that as the third airflow developes after passage of the air through the perforated portion, the outside of the frustoconical crown section 102 diverts the air into a straight, axial direction. This is facilitated by orienting the sawtooth shaped edge portion 104 of the crown section parallel to the axis of the burner as is illustrated in FIG. 2.

If the burner is relatively small, say if the small burner throat opening 14 has a diameter of less than about 10", the air tube 76 is provided with a radially oriented tubular fitting 112 and a mounting flange 114 in shell 64 which is aligned with the fitting so that a pilot light (not separately shown in the drawing) can be inserted therethrough. For such relatively small diameter burners the axial positioning of the pilot light would otherwise be difficult because of the provision of core tube 81 in the center of the burner.

Referring now to FIGS. 2 and 4–6, for operation of the burner with gaseous fuel, e.g. natural gas, a plurality of say six or eight gas spuds 20 project radially into air tube 76 at a point just downstream of liquid fuel nozzle 18. A ringshaped manifold 116 concentrically surrounds the air tube and includes a pipe nipple 118 for connection of the manifold to a source of gas (not separately shown). The radially outer end 120 of the spuds is threaded into corresponding threaded, radially inwardly oriented openings in the manifold so that gas introduced into the manifold flows into the spuds for discharge therefrom as is further described below.

Each spud is defined by a tubular member, e.g. by a length of pipe 122, the radially inner end of which is defined by a cap 124 which is slanted, i.e. which is obliquely inclined with respect to both the axis of the pipe and the axis of the burner, and which further generally faces in the direction of the airflow through air tube 76. Each cap includes a plurality of gas discharge holes 126 which have a relatively large diameter, preferably in the range of between about $\frac{1}{4}''$ to about $\frac{1}{2}''$. The cap is constructed of a relatively thick plate, its thickness being at least about 0.75 times the diameter of holes 126 and it is sealingly secured to the pipe as with welds 128. Upon the introduction of gas into manifold 116, gas streams flow from gas discharge holes 126. The holes are arranged and oriented as is more fully described below. However, by virture of the relatively large hole diameters and the relatively large plate thickness the gas streams isuing from the gas discharge holes 126 are highly directionalized. Further, the large hole diameter permits the discharge of a relatively large gas volume without high pressures, a pressure of 10 psi being normally sufficient for purposes of the present invention. This, in turn, prevents turbulence in the flame as is further discussed below.

The relative position and angularity of the gas discharge holes 126 is selected so that the vectoral component of the issuing gas stream, that is the path of each gas stream as determined by the direction, speed and momentum given to it as it issues from its discharge hole and the additional directional change, speed and momentum imparted to such stream as a result of its contact with and entrainment in the second combustion airflow 44, carries the gas stream towards the firing chamber 6 without interfering, that is without crossing the path of any of the other gas streams discharged by any of the other holes of the spud in question or by the other spuds provided in the burner. Further, the holes are oriented so that the individual gas streams evenly distribute over the space occupied by the second airflow 44 between the gas spuds 20 and about the ends of burner throat 10. Still further, the discharge openings 126 are oriented so that the gas streams also cover the radially outer portion of the first combustion airflow 40, that is the portion of that airflow radially outward of a low pressure center zone 130 which is a result of the presence in the core stream of both the stabilizer 22 and, to a lesser extent, the oil nozzle 18. In this low pressure zone, there is relatively little combustion air and it induces certain eddy currents within the first airflow which are beneficial to maintaining a stable flame and anchoring it to the nozzle.

Figure 6:
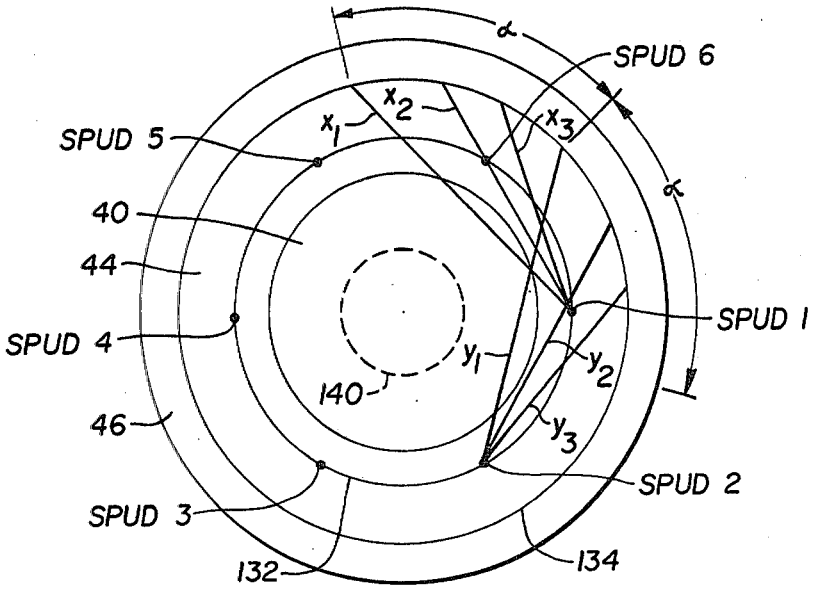
FIG. 6 is a schematic diagram which graphically illustrates the trajectory of the gas streams discharged by the gas spuds into the combustion airstream as it enters the burner throat.

FIG. 6 is a schematic illustration of a gas stream discharge pattern for two spuds. The drawing illustrates the concentric first and second airflows 40, 44 and, in the lower portion of the figure, also illustrates the enveloping third airflow 46. Circle 132 denotes the pitch diameter for the spuds and lines $X_1$–$X_3$ and $Y_1$–$Y_3$ illustrate the gas discharge direction for four gas streams originating at spud 1 and spud 2, respectively.

In the presently preferred embodiment of the invention, each spud has 5 gas discharge openings. However, in the view of FIG. 6 two trajectories are coincident so that only three ($X_1$–$X_3$, $Y_1$–$Y_3$) are illustrated.

In actual operation the linear discharge direction of the gas streams is transformed into a spiralling gas flow path and although FIG. 6 appears to indicate that the various gas streams interfere with each other, in fact, they do not because of the downstream flow component introduced into the gas streams by the first and second combustion airflows 40, 44. Thus, apparent gas stream crossing points in FIG. 6 are relatively offset in an axial direction, that is one gas stream is behind the other as seen in FIG. 6. Further, although the schematic illustration in FIG. 6 seems to indicate that the gas streams travel beyond the boundary 134 of the second combustion airflow, this in fact does not take place. By the time the gas streams arrive at the inside end of burner throat 10, the gas streams are substantially fully diffused and merged into one coherent flame which, as above described, further expands in a radial outwardly direction into the firing chamber 6 of the furnace.

The important thing in connection with the arrangement of the gas discharge openings 126 is that they are selected by taking into account the momentum of each gas stream and the change in its travel direction induced by the combustion airflows. With this in mind, the discharge holes are arranged so as to prevent the above-discussed interference while assuring a substantially even distribution of gas from the spuds into the entire cross-section of the first and second combustion airflows (except for the low pressure center zone 130) so as to effect an intimate and thorough mixing of the gas with combustion air and a complete combustion of the gas with low excess air.

This latter objective is enhanced by the fact that the gas streams are of a relatively large diameter and, therefore, they have a relatively large momentum. Consequently, it takes a relatively long time before the streams are broken up by the airflows. The streams can, therefore, be directed axially downstream into the burner throat with relatively high accuracy without requiring the heretofore necessary high gas discharge velocities (and pressures) which, in turn, rendered the flame relatively turbulent with the above-discussed drawbacks that result therefrom. Typically, the gas spuds can be operated with as little as 10 psi gas pressure while the airflow speeds past the gas spuds may be in the vicinity of about 5,000 ft. per minute.

Figure 7:
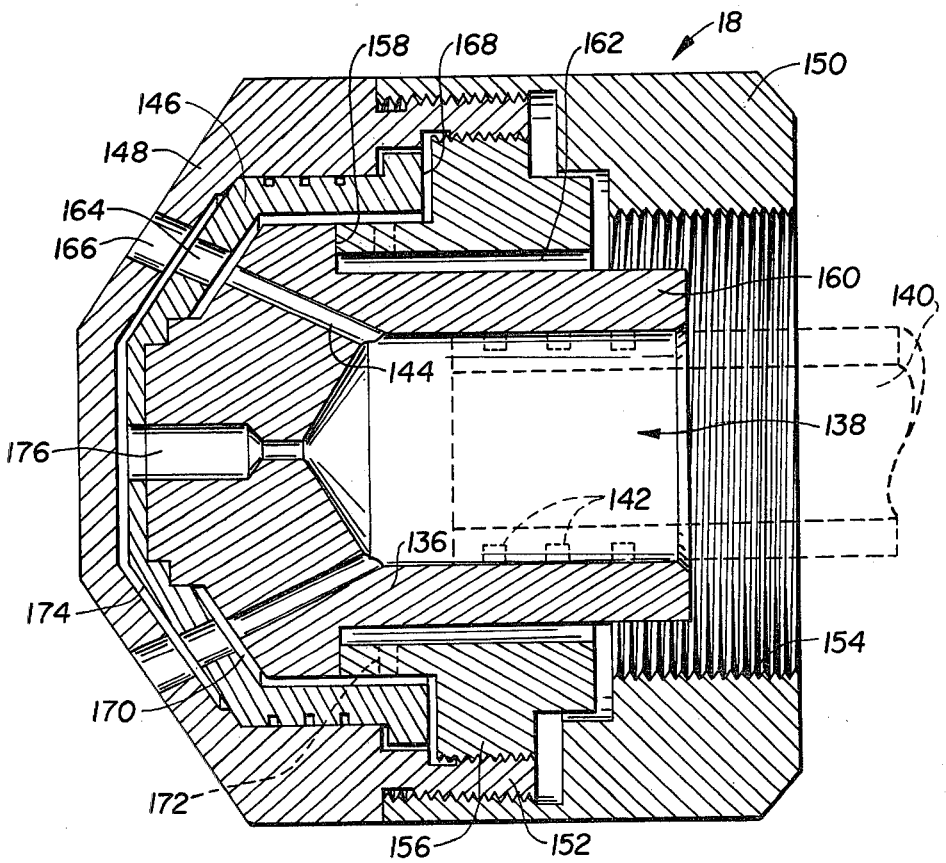
FIG. 7 is an enlarged, side elevational view, in section, of a liquid fuel atomizing nozzle constructed in accordance with the present invention.

Referring now to FIGS. 2 and 7, fuel nozzle 18 of the present invention is constructed so that it can operate with as little as 0.05 lb. of steam per every lb. of liquid fuel discharged by the nozzle. This amounts to approximately one-third the steam requirement of conventional nozzles. Further, the accumulation of soot, coke, etc. by the nozzle is prevented. This is accomplished as follows.

The nozzle has an inner member 136 which defines a steam chamber 138 that is coaxial with the nozzle axis. The chamber opens rearwardly (to the right as seen in FIG. 7) and has a smooth cylindrical surface so that a steam supply pipe 140 (shown in phantom lines) can be slidably inserted into the inner member. The supply pipe includes grooves 142 for establishing a seal labyrinth between the pipe and the steam chamber.

A cup-shaped insert 146 which has a cylindrical portion extending rearwardly over and surrounding the inner member 136 is placed over the latter and a nozzle cap 148 which, in turn, surrounds the insert is placed over the latter. The nozzle further includes an end fitting 150, the forward end of which threadably and sealingly engages a rearwardly protruding, cylindrical portion 152 of the cap while its aft end includes a threaded aperture 154 for connection to fuel supply pipe 32 (not shown in FIG. 7) which concentrically surrounds steam supply pipe 140. Lastly, the nozzle includes a ring 156 which threadably and sealingly engages the inside of cylindrical cap portion 152 and which abuts against a shoulder 158 of the inner member 136. The ring is circumferentially spaced from an aft end 160 of the inner member to define therebetween a liquid fuel, e.g. oil receiving compartment 162.

Upon the tightening of ring 156 against shoulder 158 of the inner member, the latter together with the insert 146 are firmly biased against the nozzle cap 148 to form a self-contained nozzle unit. Fitting 150 can be threaded onto and removed from this nozzle unit to provide access to the interior of the unit should that become necessary.

The inner member 136 includes a plurality of equally spaced, circumferentially arranged steam discharge conduits 144 which extend at a slight angle to the nozzle axis of as little as 15°–30° (and preferably in the range of between 24°–26° in a forward direction. The insert 146 includes a like plurality of first holes 164 which are aligned with steam conduits 144 and which have a diameter larger than that of the conduits. The cap 148 includes a like plurality of second holes 166, which form the fuel discharge jets of the nozzle, and which are similarly aligned with steam conduits 144. Their diameter is larger than the diameter of the first holes. Thus, the first and second holes are aligned with, are successively further spaced from, and have successively larger diameters than steam conduits 144.

The rearwardly facing side of insert 146 between its aft end 168 and the first hole 164 is recessed so as to form a shell about the inner member 136. The annular space between the side of insert 146, or shell, and the inner member 136, in turn, forms first channel or passageway which extends from the aft end to the first hole. The first passage is formed so that it entirely surrounds the second hole. A plurality of tangentially oriented oil supply holes 172 extend through ring 156 from oil compartment 162 to the first passage so that pressurized oil introduced into the compartment can flow into the first passage and hence towards first hole 164. When steam is applied to steam chamber 138, it flows through steam conduit 144 and hence through the first and second holes 164, 166 to form a core steam flow. Pressurized oil applied compartment 162 flows through the first passage 170 and around the entire circumference of the first hole 164 co-axially about the steam core stream to form an annular oil flow which surrounds the steam core and which flows through the first hole towards the second hole. To assure an even distribution of the oil flow to all first holes the tangent holes are slanted so as to impart to the oil entering the first passage 170 a swirling motion. This results in a more even oil distribution to all first holes. Preferably, the number of oil supply holes 172 exceeds the number of first holes by a factor of up to 2.

During operation the nozzle cap 148 is subjected to intense heat radiation. If oil to be atomized contacts the cap, e.g. the walls of the second hole 166, it has a tendency to coke along the walls. Although the normally high oil velocity will prevent a clogging of the hole the coke or carbon is later on deposited on the furnace walls, the stack and the like as soot and may further accumulate at a point of discharge of the oil from the cap, making it necessary to frequently clean the nozzle.

To prevent this from happening the cap is constructed so that a portion of its inwardly facing surface opposite the outwardly facing surface of insert 146 is spaced therefrom to define a second passage 174 which communicates with all second holes 166 and which entirely surrounds the second holes in the same manner in which the first passage surrounds the periphery of the first holes. Further, an aperture 176 communicates the steam chamber 138 with the second passage 174. Thus, upon the application of pressurized steam to chamber 138, the steam flows via the aperture and the second passage to the second hole 166. There it flows as an annular steam envelope which entirely surrounds the annular oil flow into the second hole and prevents contact between the walls of the second hole, that is between the cap 148 and the oil stream, thereby preventing the above-discussed coking and sooting.

In operation, steam is continuously fed to chamber 138 while oil is fed to the compartment 162. From there the steam primarily forms a core flow through steam conduits 144 which, as it travels outwardly through the first and second holes 164, 166 is first enveloped by the annular oil flow which, in turn, is enveloped by the annular steam sheath. Upon discharge of this composite steam-oil flow from the second hole the core stream expands and atomizes the liquid fuel into fine, evenly divided droplets which are then combusted in the above-described manner.

A main advantage of the oil atomizing nozzle of the present invention is the fact that the steam conduits 144 extend obliquely away from the steam chamber, typically at an angle to the nozzle axis of less than 45° and preferably at an angle of between 15°–30°. This slight deviation of the conduits from the straight line greatly reduces energy losses in the steam and facilitates the smooth and rapid acceleration of the steam entering the conduit and hence the first and second holes. As a result the energy contained in the steam is efficiently utilized for atomizing the liquid fuel rather than for forcing the steam through intricate and multiple sharp turns, bends and the like. As a result thereof, the nozzle can be operated as efficiently as prior art nozzles while consuming as little as one-third the steam of such prior art nozzles. This significant reduction in the steam consumption can result in annual cost savings per nozzle due to the reduced energy consumption for generating the atomizing steam of as much as $10–20,000 per year.

We claim:

1. A burner for a furnace comprising a centrally located nozzle for the discharge of fuel in a downstream direction towards a combustion chamber of the furnace; a burner throat located between the nozzle and the combustion chamber; means for forming a first, combustion airflow substantially co-axially about the nozzle; means for flowing a second combustion airstream co-axially about the first airstream past the nozzle and towards the chamber; means for forming a third airstream formed generally coaxially about and enveloping the second airstream at a point downstream of the nozzle; and means forming said second and third airstreams including a tubular conduit mounted within the burner at a location downstream of the nozzle, the tubular conduit opening toward the burner throat and having an outer diameter less than the diameter of the burner throat; whereby the third airstream limits the diameter of a flame produced by the nozzle and thereby prevents substantial contact between the flame and a burner throat defined by the furnace; said means for forming the third airflow including means for directing the third airflow along an outside of the tubular conduit towards the burner throat; the end of said tubular conduit proximate the burner throat defining an edge having at least one segment obliquely inclined relative to the axis of said tubular conduit; and means disposed upstream of the nozzel for imparting to the first airstream only a swirl motion.

2. Apparatus according to claim 1 wherein the cross-sectional areas of at least portions of the means for forming the first airstream and the means for forming the second airstream are approximately equal.

3. A burner according to claim 2 including means for varying the flow ratios in the first and the second airflows.

4. A burner according to claim 1 wherein the end of the conduit defines a generally sawtooth-shaped edge.

5. A burner according to claim 4 wherein the edge defines at least about ten sawtooth shaped protrusions.

6. A burner according to claim 5 wherein the number of sawtooth shaped protrusions is between about ten and sixteen.

7. A burner according to claim 1 wherein the burner is mounted to a furnace wall co-axially with the burner throat, and including means disposed about the burner throat and extending through the wall from the exterior thereof to the furnace chamber for establishing a fourth combustion airflow to enable the off-stoichiometric firing of the burner.

8. A burner according to claim 7 wherein the fourth airflow establishing means is defined by a plurality of independent, spaced apart passages extending through the wall and arranged about the burner throat.

9. A burner according to claim 8 wherein an end of the passages facing the furnace chamber is flattened in a direction generally parallel to a proximate periphery of the burner throat.

10. A burner according to claim 1 including a plurality of spaced apart gas spuds arranged in the second airflow, each spud including a cap generally facing in the direction of the airflow, each cap including a plurality of relatively large diameter gas discharge openings so that a gas stream issues from each such opening and enters the second gas stream, the cap having a thickness at least about equal to 0.75 the diameter of one of the openings, the openings being further arranged so that the gas stream discharged by each follows a trajectory which prevents an interference of such stream with the streams discharged by the other openings and further so that all gas streams together, at points downstream of the spuds, substantially fully penetrate the space occupied by the second airflow and at least a portion of the first airstream.

11. A burner according to claim 10 wherein the openings are further arranged so that the gas streams discharged by the cap openings bypass a center core of the first airstream.

12. A burner according to claim 10 including means for supplying the spuds with gas pressurized to no more than about 10 psi.

13. A burner according to claim 10 wherein all spuds block no more than about 30% of the cross-section of the second airflow.

14. A burner according to claim 10 wherein the diameter of the holes in the caps is at least about $\frac{1}{4}''$.

15. A burner according to claim 10 wherein each spud is defined by a tubular member extending in a radial direction from an exterior of the burner into the second airflow, and wherein the cap is obliquely inclined relative to an axis through the burner and an axis of the tubular member and faces in the direction of the second airflow.

16. A burner according to claim 11 wherein the openings are further arranged so that substantially no portion of the gas streams discharged by the openings flow radially beyond the second airstream.

17. A burner according to claim 1 wherein the nozzle comprises a housing defining a steam chamber for connection to a source of steam and a separate compartment for connection to a source of liquid fuel; a discharge conduit extending through the housng and communicating the steam chamber with an exterior of the housing so as to flow a center stream of steam in the conduit; means defining a first passage in communication with the compartment and the conduit at a first point intermediate the steam chamber and the exterior of the housing, the first passage defining means being arranged so as to flow the liquid fuel generally annularly about steam streaming from the steam chamber through the conduit; and means defining a second passage communicating the steam chamber with the conduit at a second point disposed between the first point and the exterior of the housing, the second passage defining means being arranged so as to flow steam generally annularly about the liquid fuel flowing in the conduit between the first point and the exterior of the housing; whereby liquid fuel is discharged from the housing in atomized form.

18. A burner according to claim 17 wherein the housing comprises an inner member defining the chamber and a shell disposed about the inner member and defining at least a portion of the compartment, and wherein the means defining the first and second passages comprises an insert disposed between the member and the shell, the insert defining a first portion of the conduit intermediate the member and the shell, and wherein the insert further includes first and second wall portions which are spaced from corresponding, opposing surfaces of the member and the shell, respectively, so that wall portions and the surfaces define the first and second passageways.

19. Apparatus according to claim 18 wherein the first conduit portion has a diameter larger than the diameter of a second conduit portion defined by the member.

20. Apparatus according to claim 19 wherein the first passage has a lateral extent in a direction transverse to an axis of the first conduit portion which is larger than the diameter of the first conduit portion.

21. Apparatus according to claim 20 wherein a third portion of the conduit is defined by the shell and has a diameter larger than the first conduit portion.

22. Apparatus according to claim 21 wherein the second passage has a lateral extent in a direction transverse to the axis of the conduit which is larger than the diameter of the third conduit portion.

23. In a furnace having a furnace wall defining at least one burner throat defined by the wall and extending through the wall from an exterior thereof into a combustion chamber of the furnace, a burner including a liquid fuel atomizing nozzle mounted concentrically with respect to the burner throat, first duct means for flowing combustion air past the nozzle towards the throat, and second duct means disposed about the first duct means for flowing a second combustion airflow substantially concentrically to the first flow past the nozzle towards the throat, the improvement to the burner comprising in combination: means for flowing an enveloping, third combustion airflow from between the wall and the second duct means at a point downstream of the nozzle about the second airflow to thereby restrict the radial extent of the flame generated by the burner and protect walls of the burner throat from the flame; a plurality of gas spuds defined by generally radially oriented tubular members extending into the second airflow, each tubular member terminating in a slanted cap facing in the direction of the second airflow, each cap having a plurality of gas discharge openings of a relatively large diameter and an orientation so that vectorial momentums of the gas streams issuing from the holes and contacted by the second airflow carries the gas streams in a downstream direction from the spuds and cause, in cross-section a substantially complete coverage by all gas streams of the space occupied by the second airstream downstream of the spuds and upstream of the chamber, and of at least a portion of the space occupied by the first gas stream; and means for supplying to the spuds gas of a pressure no more than abut 10 psi.

24. A burner according to claim 23 including means establishing an air velocity in the vicinity of the gas spuds of at least about 5,000 ft. per minute.

25. A burner according to claim 23 including a plurality of spaced apart, independent conduits extending through the wall and arranged about the burner throat for providing a fourth combustion airflow and for enabling the off-stoichemetric firing of the burner.

26. A burner according to claim 23 wherein the means for flowing the third airflow includes means defining an opening surrounding the second airflow and disposed between the wall and the second duct means.

27. A burner according to claim 26 wherein the means defining the surrounding opening comprises a perforated, tubular member.

28. A burner for a furnace comprising a centrally located nozzle for the discharge of fuel in a downstream direction towards a combustion chamber of the furnace, the nozzle including a housing defining a chamber, an aperture and a spaced apart conduit both in fluid communication with the chamber, the aperture and the conduit extending generally in an axial direction, the conduit extending to an exterior of the housing and comprising first, second and third aligned conduit sections of successively larger diameters from the chamber to the exterior of the housing, the housing also defining a compartment separate of the chamber; means for connecting the chamber to a supply of steam; means defining a first passage communicating the compartment with an upstream end of the second conduit section, the first passage being arranged and dimensioned so as to extend in a radial direction about the conduit; and means defining a second passage communicating the aperture with an upstream end of the third conduit section, the second passage being dimensioned and arranged so as to extend in a radial direction about the second hole; whereby a steam-atomized liquid fuel flow exits from a downstream end of the third conduit section upon the application of steam to the chamber and the application of pressurized liquid fuel to the compartment, the flow comprising a steam core flow, an annular liquid fuel flow surrounding the core flow, and an annular steam flow enveloping the liquid fuel flow so that the annular steam flow prevents contact between the liquid fuel and walls of the third conduit section; means for forming a first, combustion airflow substantially co-axially about the nozzle; means for flowing a second combustion airstream co-axially about the first airstream past the nozzle and towards the furnace chamber; and means for flowing a third airstream generally co-axially about the second airstream at a point downstream of the nozzle, the last mentioned means being formed to substantially fully envelop the second airstream with the third airstream; whereby the third airstream limits the diameter of a flame produced by the nozzle and thereby prevents substantial contact between the flame and a burner throat defined by the furnace; a plurality of spaced apart gas spuds arranged in the second airflow, each spud including a cap generally facing in the direction of the airflow, each cap including a plurality of relatively large diameter gas discharge openings so that a gas stream issues from each such opening and enters the second gas stream, the cap having a thickness at least about equal to 0.75 the diameter of one of the openings, the openings being further arranged so that the gas stream discharged by each follows a trajectory which prevents an interference of such stream with the streams discharged by the other openings, so that all gas streams together, at points downstream of the spuds, substantially fully penetrate the space occupied by the second airflow while no more than a minor portion of all gas streams impinges on the first airstream and further so that substantially no portion of the gas streams discharged by the openings flows radially beyond the second airstream.

* * * * *